United States Patent [19]

Bonvallet et al.

[11] Patent Number: 4,951,088

[45] Date of Patent: Aug. 21, 1990

[54] TONER MASS DEVELOPED CONTROL RATIO MODIFICATION SYSTEM

[75] Inventors: John C. Bonvallet; Jimmie Ray Brewster, both of Boulder; James R. Champion, Longmont; Kenneth S. Shouldice, Louisville, all of Colo.

[73] Assignee: International Business Machines Corporation, Armonk, N.Y.

[21] Appl. No.: 283,708

[22] Filed: Dec. 13, 1988

[51] Int. Cl.[5] ..... G03G 15/00; G03G 15/08

[52] U.S. Cl. ..... 355/77; 355/203; 355/208; 355/245; 430/30; 118/712; 118/691

[58] Field of Search ..... 355/77, 132, 203, 204, 355/208, 245, 265, 228, 229; 430/30, 35; 118/691, 663, 712

[56] References Cited

U.S. PATENT DOCUMENTS

| | | | |
|---|---|---|---|
| 4,082,445 | 4/1977 | Steiner | 355/246 |
| 4,215,930 | 8/1980 | Miyakawa et al. | 355/208 |
| 4,239,372 | 12/1980 | Iwai | 355/246 |
| 4,279,498 | 7/1981 | Eda et al. | 355/246 |
| 4,313,671 | 2/1982 | Kuru | 355/214 |
| 4,318,610 | 3/1982 | Grace | 355/246 |
| 4,326,646 | 4/1982 | Lavery et al. | 222/56 |
| 4,341,461 | 7/1982 | Fantozzi | 355/246 |
| 4,348,099 | 9/1982 | Fantozzi | 355/208 |
| 4,372,672 | 2/1983 | Pries | 356/448 |
| 4,372,674 | 2/1983 | Yukawa et al. | 355/208 |
| 4,377,338 | 3/1983 | Ernst | 355/246 |
| 4,468,112 | 8/1984 | Suzuki et al. | 355/246 |
| 4,502,778 | 3/1985 | Dodge et al. | 355/206 |
| 4,519,695 | 5/1985 | Murai et al. | 355/246 |
| 4,533,234 | 8/1985 | Watai et al. | 355/246 |
| 4,550,254 | 10/1985 | Zomorrodi et al. | 250/338 |
| 4,572,654 | 2/1986 | Murai et al. | 355/214 |
| 4,639,117 | 1/1987 | Murai et al. | 355/246 |

FOREIGN PATENT DOCUMENTS 2141050 12/1984 United Kingdom .

*Primary Examiner*—A. C. Prescott

*Attorney, Agent, or Firm*—Charles E. Rohrer

[57] ABSTRACT

A toner mass developed control system for use with electronic printers or copiers provides for the measurement of toned photoconductor reflectivity and bare photoconductor reflectivity. The standard control ratio is modified by characterizing the particular sensor unit in use and by taking into account the reflectance from both photoconductor and toner in the toned patch reflectivity measurement. These factors together with a modification for photoconductor reflectance degradation enable accurate control in high optical density development and with highly reflective color toners by altering the control ratio in accordance with these factors.

21 Claims, 4 Drawing Sheets

TONER MASS DEVELOPED CONTROL RATIO MODIFICATION SYSTEM

This invention relates to image producing machines such as electronic printers and copiers and more particularly to controlling the density of toner deposits by using a reflectivity control system in which the control ratio is modified in accordance with reflectance degradation of the image receiving material and with characterization of the individual reflectance sensing unit.

BACKGROUND OF THE INVENTION

Image producing machines such as electronic printers and copiers are frequently of the electrophotographic type. In electrophotographic printers, a print is produced by creating an image of the print on a photoreceptive surface, developing the image and then fusing the image to print material. In machines which utilize plain bond paper or other ordinary image receiving material not specially coated, the electrophotographic process is of the transfer type where a photoreceptive material is placed around a rotating drum or arranged as a belt to be driven by a system of rollers. In the typical transfer process, photoreceptive material is passed under a stationary charge generating station to place a relatively uniform electrostatic charge, usually several hundred volts, across the entirety of the photoreceptive surface. Next, the photoreceptor is moved to an imaging station where it receives light rays which are modulated in accordance with the data to be printed. The light generator may produce laser beams, it may be an array of light-emitting diodes, or it may be any other suitable light source. The light rays are directed to the photoreceptor and cause it to bear a charge pattern which is a latent image of the information used to modulate the light rays. Modulation is usually derived from a character generator which is driven by image pattern data frequently produced by a computer and held in digitized form in memory.

After producing an image on the photoreceptor, the next step in the electrophotographic process is to move the image to a developing station where developing material called toner is placed on the image. This material may be in the form of a colored powder which carries a charge and is electrostatically attracted to those areas which it is desired to develop. Thus, pels representing character printing should receive heavy toner deposits, white background areas should receive none, and gray or otherwise shaded portions should receive intermediate amounts. To aid in attaining these results, a bias voltage is usually placed on the developer station to alter the magnitude of electrostatic fields in the development zone. Thus, the bias voltage is established at a level which provides a field development vector to move the charged toner particles away from the developing station toward the areas to be developed while simultaneously establishing an electrostatic field development vector to move the charged toner particles away from the background areas toward the developing station.

The photoreceptor, with a developed image, is moved from the developer to a transfer station where print receiving material, usually paper, is juxtaposed to the developed image. A charge is placed on the backside of the print paper so that when the paper is stripped from the photoreceptor, the toner material is held on the paper and removed from the photoreceptor. Any toner remaining on the photoreceptor after transfer is removed by a cleaning station before the photoreceptor is reused.

The electrophotographic process is frequently used as a copy process as well as a printing process. In the copy process, a document to be copied is placed on a document glass and light is reflected from the original onto the photoconductor. Since white areas of the original document reflect large amounts of light, the photoreceptive material is discharged in white areas to relatively low levels while the dark areas continue to contain high voltage levels even after exposure. At the developing station, the toner material carries a charge opposite in polarity to the charge pattern on the photoreceptor. Because of the attraction of the oppositely charged toner, it adheres to the surface of the photoreceptor in large amounts on the undischarged areas representing the dark areas of the original document. This process is called a charged area development (CAD) process since heavy toner deposits are made on the heavily-charged areas of the photoconductor after exposure.

In electrophotographic printers, a CAD process can be used, but it is often preferable to use a discharged area development (DAD) process, primarily because line and character printing results are usually improved. In the DAD process, the light-generating source, such as a laser beam or an array of light emitting diodes, etc., discharges the photoconductor in those areas which are desired to be developed; thus, the highly-charged areas of the photoconductor represent white background, whereas the discharged areas represent areas in which toner is to be deposited. In the DAD process, toner material carries a charge of the same polarity as the charge pattern on the photoreceptor. Because of the repulsion of the similarly charged toner, it does not adhere to the highly-charged background areas, but instead deposits in the more lowly charged discharged areas.

In many printers, a dual component developing mix is utilized in order to produce the desired charge level on the toner and/or to move the toner to the development zone. For example, in many magnetic brush developers, magnetic beads and toner particles comprise the developer mix. The carrier material and toner particles are churned in the developer to produce a triboelectric charge such that the toner particles are attracted to the carrier. The magnetic carrier material is then moved by magnetic fields to the development zone carrying the charged toner particles therewith. As described above, toner particles are then developed onto the photoconductor and eventually transferred to print paper and moved out of the machine. Therefore, a need to replenish toner particles in order to maintain proper toner particle concentration in the developer mix is essential to good machine operation. Other printers use a monocomponent developing material, toner alone, which receives a charge and develops out onto the photoconductor. Again, toner supply in the developer must be replenished so that the machine can continue to produce output.

While the background of the invention has been provided with reference to electrophotographic printers, the problems of developing a desired toner mass on the print are found in other non-impact electronic printing processes such as ion deposition and magnetic. The invention herein applies to these other processes as well.

One of the best toner concentration control systems found in the prior art is often called the "toner patch" control system. In that system, a small patch of toner is developed on the photoconductor and its reflectivity is sensed and compared to a reference stored in memory. The difference is then used to control the replenishment apparatus to reestablish proper toner concentration.

An important refinement of the patch control system is the use of control ratios as opposed to a difference control. In the ratio system, the reflectivity of bare photoconductor is sensed and compared to the reflectivity of the toned patch. That ratio is compared to a desired control ratio and the difference used to reestablish proper toner concentration. The desired control ratio was not a calculated quantity in prior art systems, it was empirically determined from test data by using an average from several different sensing units or by manual adjustment of the sensing circuit each time a sensing unit was changed. The desire to calculate the control ratio setpoint and avoid the need for manual adjustment stimulated the discoveries which are central to the instant invention. It should be observed that the ratio system of the prior art provided better results than the simple difference control since it included a signal derived from the actual bare photoconductor in use. The improvement was derived from the fact that as the photoconductor surface reflectance changed through usage, the ratio system would automatically compensate for the change.

The invention herein, however, recognizes that previous ratio control algorithms did not consider the effect of toned patch reflectivity when toner reflectivity is high and/or where toner coverage of the patch is high, that is, for high optical density development. In such case, the previous ratio control techniques are not self-compensating for photoconductor degradation. Moreover, previous control algorithms did not take into account the optical difference from sensor to sensor, therefore necessitating the addition of expensive optical components to smooth out such difference, or necessitating manual adjustment of the system when it was manufactured and whenever the sensor unit was changed.

It is the object of the invention to provide a toner patch sensing system that operates in a self-compensating manner for high optical density development It is another object to provide a toner patch control system that will provide accurate results for toner whose reflectivity is high, as is often the case with non-black toners and is sometimes the case for black toners.

It is another object of the invention to provide a toner patch control system that provides accurate results regardless of the reflectivity of the particular photoconductor in use and regardless of degradation in photoconductor reflectivity.

It is still another object of the invention to provide a toner patch control system that is insensitive to the particular installed sensor unit such that no manual adjustment of the system is needed or, at the most, simple operator controlled parameter changes can insure continued non-deviant operation when sensor units are changed.

It is another object of the invention to provide an accurate toner patch sensing system in order to keep toner mass developed at the proper level by adjusting one or more factors affecting toner mass developed including toner concentration, charge level on the photoreceptor, illumination intensity, or developer bias voltage.

It is still another object of this invention to provide an accurate toner patch sensing system for toners regardless of color and for monocomponent developers as well as multiple component developer mixes.

SUMMARY OF THE INVENTION

This invention relates to a method of controlling the mass of toner developed onto the image receiving surface of an image producing machine by calculating a control ratio setpoint from an algorithm that includes a variable that is dependent upon the reflectivity sensing characteristics of the particular sensing unit in use. That variable is derived from the maximum ratio of the reflectivity of toned mass to bare photoconductor that the particular sensing unit in use is able to sense. The method is further refined by including a variable in the control ratio algorithm which represents the ratio of the bare reflectivity of an unused image receiving surface to the bare reflectivity of the image receiving surface in current use.

BRIEF DESCRIPTION OF THE DRAWING

The above-mentioned and other features and objects of this invention and the manner of attaining them will become more apparent and the invention itself will best be understood by reference to the following description of embodiments of the invention taken in conjunction with the accompanying drawings, the description of which follows.

DETAILED DESCRIPTION

Figure 1:
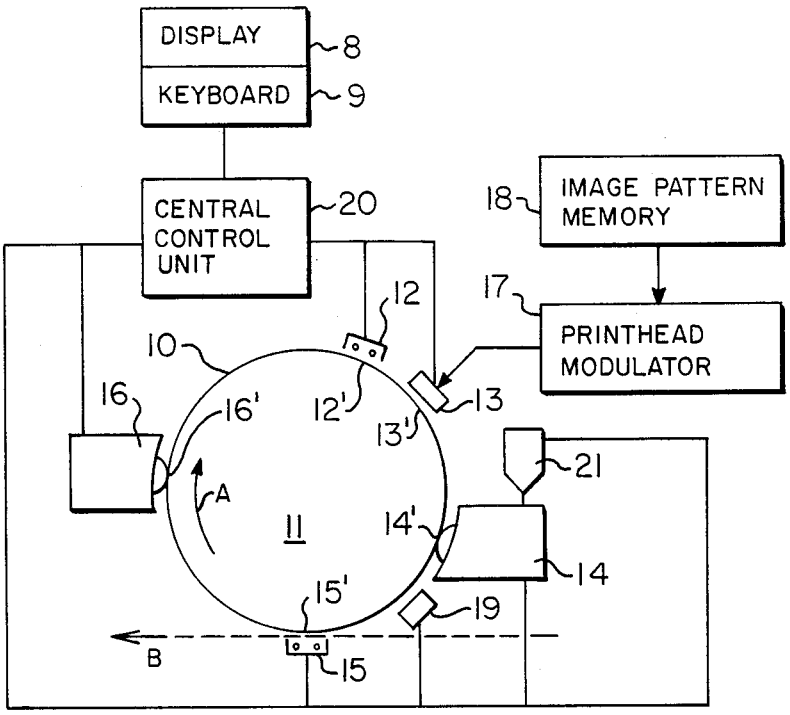
FIG. 1 is an illustration of a typical electrophotographic machine.

FIG. 1 shows a typical electrophotographic machine such as would be used to implement this invention. Photoreceptive material (photoconductor) 10 is placed on the surface of a drum 11 which is driven by a motive means not shown, to rotate in the direction A. A charge generator 12 places a uniform charge of several hundred volts across the surface of the photoreceptor at charging station 12'. The charged photoreceptor is mounted in a dark enclosure, not shown, and rotates to a printhead 13 which can be comprised of a suitable light generating source such as a laser generator. The light source selectively exposes the charged photoreceptor at imaging station 13' to discharge it in areas which are desired to be developed (DAD process). The selective application of light rays to the photoreceptor 10 at imaging station 13' is accomplished through printhead modulator means 17. Modulation occurs in accordance with data contained in image pattern memory 18.

The discharged areas of the photoreceptor are developed at developing station 14' by developer apparatus 14 which applies toner to the photoreceptor in order to produce a visually perceptible image of the data. A developer bias voltage is usually applied to the developer in order to set up fields to keep the background area clear while depositing toner on the discharged areas. The developed image rotates to transfer station 15' where print paper, moving in the direction B, is juxtaposed with the surface of the photoreceptor. A charge opposite in polarity to the charge of the toner is placed on the backside of the paper by transfer charge generator 15, such that when the paper is stripped from the surface of the photoreceptor, toner will be attracted to the paper and leave the surface of the photoreceptor 10. Any remaining residual toner is cleaned from the photoreceptor at cleaning station 16' by cleaning apparatus 16.

A toner patch control unit 19 is placed near the photoconductor 10 subsequent to developing station 14' in the direction of rotation. Unit 19 senses when toner mass developed is not at a correct level and thereby enables corrective action to take place. For example, control unit 20 could take corrective action by calling for an adjustment of the charge level produced on the photoconductor by charge generator 12, it could call for an adjustment of the illumination produced on the photoconductor at imaging station 13', it could call for an adjustment of the developer bias voltage or it could call for altering the replenishment of the toner supply. In some machines, a combination of these controls are used, for example, an adjustment of charge level to obtain an immediate short term correction of toner density developed while initiating a change in toner replenishment as a longer term correction by activation of replenisher device 21 to add toner to the developer mix in developer 14 (multiple component developer).

Central control unit 20 controls the operations of the machine and display 8 and keyboard 9 afford means through which the machine operator can interact with control unit 20. Thus, if desired, the control level for correct toner mass developed can be adjusted through keyboard 9.

Figure 2:
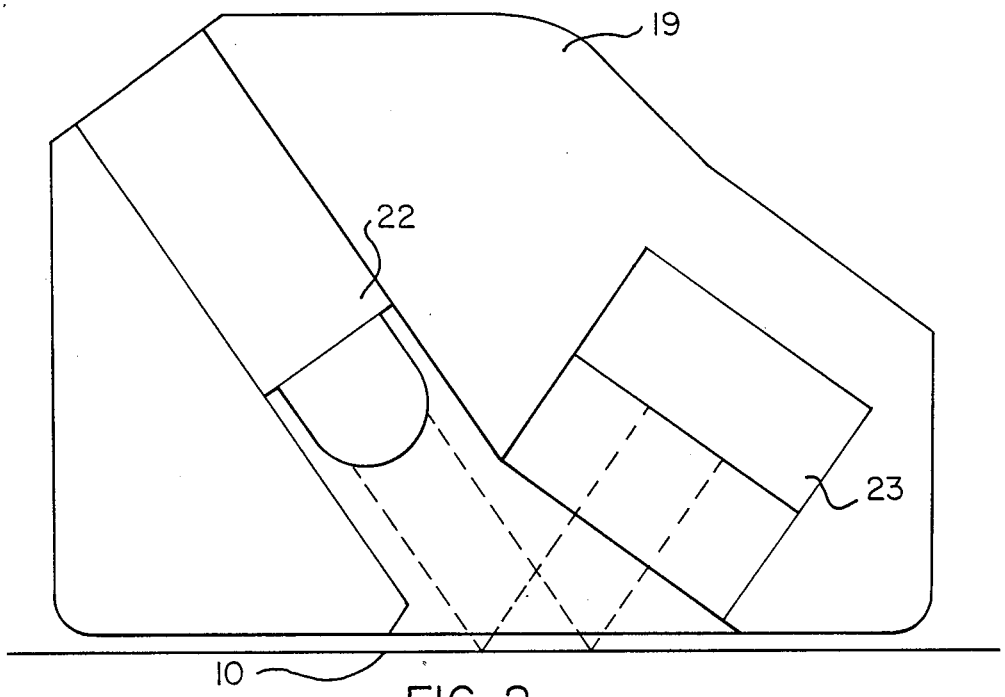
FIG. 2 shows a toner patch sensor unit for use in the machine of FIG. 1, and also shows specular reflectance from the photoconductor.

FIG. 2 shows the components of toner patch sensing unit 19. A light emitting diode (LED) 22 emits light radiation to photoconductor 10 from where the light is reflected to photosensor 23. The envelope of the light beam is illustrated as comprising a beam which strikes the surface of photoconductor 10 and is reflected in a specular manner to the photosensor 23. FIG. 2 is an idealistic version of the light rays which emanate from LED 22 in that there is no spreading of the beam envelope.

Figure 3:
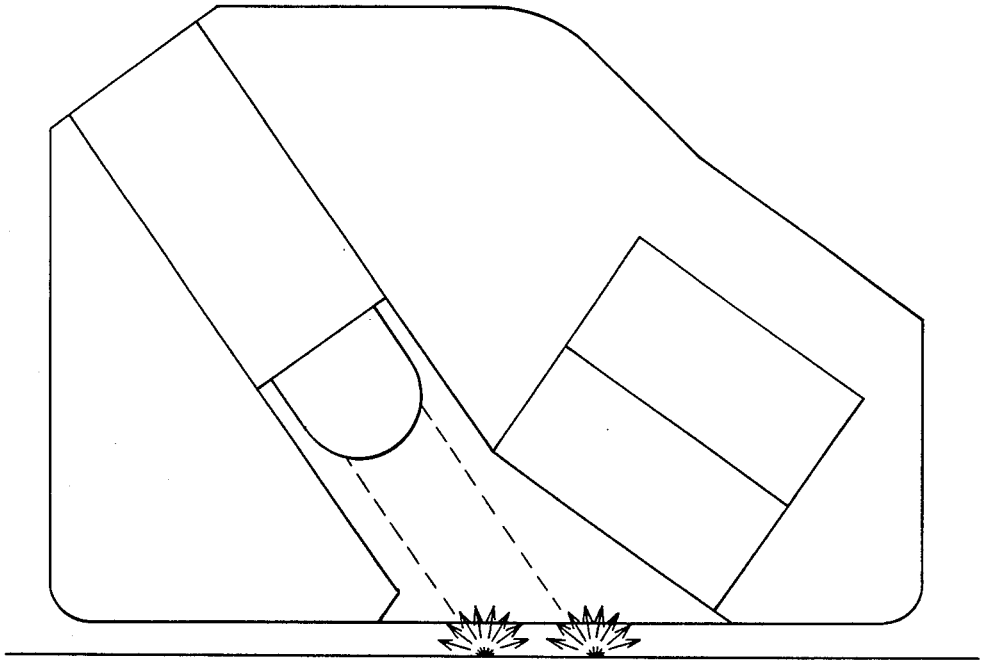
FIG. 3 shows the unit of FIG. 2 illustrating diffuse reflectance from toner particles.

In the prior art, unit 19 was operated to provide a measurement of bare photoconductor reflectance and a measurement of the reflectance of a toned patch on photoconductor 10. The measured ratio was the signal produced from the bare patch divided by the signal produced from the toned patch. That ratio was then compared to a desired control ratio to determine whether toner should be added or not. While the same measurement is still used in the practice of the instant invention, the inventors herein have come to realize that the simple algorithm previously used to set the control ratio does not take into account all variables which are present in the toner patch control measurement. For example, while FIG. 2 illustrates a specular reflection from photoconductor 10 which is the case for bare photoconductor, it is only partially the case when the reflectivity of a toned patch is to be sensed. In the latter case, a certain portion of the light from LED 22 strikes toner particles creating a diffused reflection situation instead of specular. FIG. 3 illustrates diffused reflection from toner particles.

When diffused reflectance is present, only a portion of the reflected light rays are sensed by photosensor 23. Since however, toner particles do not necessarily cover the entire surface of the toned patch on the photoconductor, a large amount of specular reflection may still be present in the toned patch reflectance measurement. Consequently, to be accurate, the toned patch reflectance measurement is comprised of two components; one being the light reflected from the area covered by toner particles, and the other component being the light reflected from the area not covered by toner particles. Therefore, a more correct version of the measured ratio formula is:

$$MR = \frac{Rpc}{(1 - a)Rpc + aRt}$$

where MR equals the measured ratio, Rpc equals reflectance of the photoconductor, Rt equals reflectance of the toner, and 'a' equals the fractional area of toner coverage.

Figure 4:
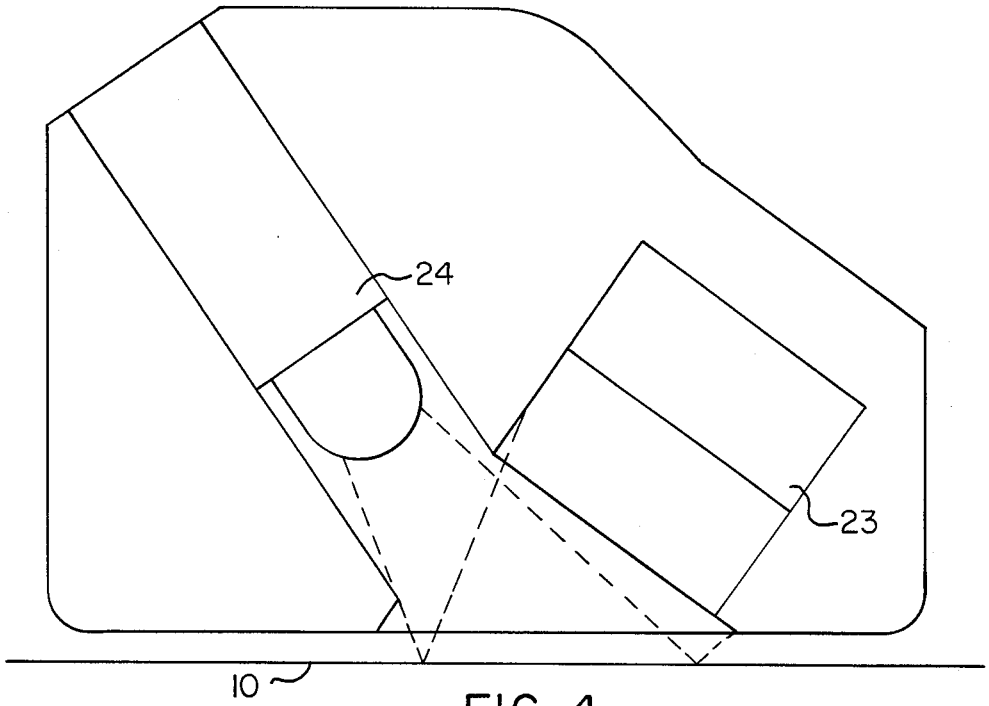
FIG. 4 shows the sensor unit of FIG. 2 illustrating specular reflectance with a spread beam.

In addition to the above, the inventors herein came to discover that still another problem with sensor units was not incorporated into the MR algorithm. FIG. 4 shows a specular reflectance situation with an LED 24 in which the beam envelope shows beam spread from the LED to the photoconductor 10. In this case, all of the light reflected from photoconductor 10 is not captured by the photosensor 23, and since specular reflectance from an untoned patch is essentially all of the reflectance measurement while specular reflectance from the toned patch is only a part of the reflectance measurement, the measured reflectance quantities do not change in the same proportion to each other as they would if the sensor unit of FIG. 2 is in use. As a consequence, the measured ratio will change if the toner patch sensor unit shown in FIG. 4 is employed in the machine of FIG. 1 as opposed to the use of the toner patch sensor shown in FIG. 2. In order to compensate for these differences in light beam spread and other differences which may exist in the optical geometry of a particular sensor unit from another sensor unit, a factor expressing the uniqueness of each sensor unit must be incorporated into the MR algorithm.

In addition, the inventors recognized that as the photoconductor surface changes due to toner film, toner dust, or surface wear during usage of the machine, the reflectance of bare photoconductor changes while the reflectance of the toner portion of the above algorithm does not change in the same proportion since some of the photoconductor is covered with toner. Therefore to produce an accurate formulation Rpc must be defined as indicating the reflectance of clean photoconductor and that must be multiplied by a factor reflecting the photoconductor degradation in a particular case.

Taking these considerations into account, a true version of measured ratio is:

$$MR = \frac{Rpc\ Ktf}{(1 - a)Rpc\ Ktf + a\ Rt\ Kg}$$

where Ktf is the photoconductor reflectance degradation factor and Kg is the sensor factor.

In the case where the machine is designed to develop at a relatively low optical density, that is, in most prior art machines, the area of the toned patch covered by toner is small, that is 'a' is small. Since the reflectance of black toner is also small, the Rt and Kg factors drop out of the equation. The result is the ideal equation previously used to obtain the measured ratio and compare it to a desired control ratio.

$$MR = \text{RATIO} = \frac{1}{1-a} = \text{RATIOideal}$$

As a consequence, in prior art machines with low optical density, and/or high photoconductor reflectance, and/or low reflectivity black toner, the self compensating nature of the ratio determination was relatively accurate. However, in machines where control is desired at high optical density levels, and/or with high reflectivity toners, and/or with low reflectivity photoconductors, the area of toner coverage is significant and toner reflectance factors and sensor geometry factors cannot be dropped out of the equation without affecting the accuracy of the toner concentration control algorithm. As a consequence, the control ratio setting must include these factors since they are a part of the ratio that is measured.

Once the inventors herein had discovered the factors that affected or destroyed the accuracy of toner reflectance measurements, the practical problem remained of how to take these factors into account and still produce an economical toner patch control system that was free of the need for maintenance personnel to provide adjustment as conditions changed. To do that, the problem of each sensor as a unique element was approached in the following manner.

(A) Modification for Sensor Characteristics

First, the toner film term (Ktf) was neglected in order to concentrate on how to take sensor geometry (Kg) into account. At first glance it would appear that the geometry term is imbedded in the denominator of the ratio equation with no way to separate it out for calculation modifications.

$$\text{RATIO} = \frac{Rpc}{(1-a) * Rpc + a * Rt * Kg}$$

But, if the area of toner of the toner patch is completely covered with toner, that is, 'a' is increased to 1 (100% toner reflectance and no photoconductor reflectance), what remains is a value that is the maximum ratio the sensor can read given the particular toner and the particular photoconductor.

$$\text{RATIOmax} = \frac{Rpc}{Rt * Kg}$$

RATIOmax is the maximum ratio which a particular patch sensor can measure. The maximum ratio is the ratio of untoned photoconductor (PC) reflectance to toner reflectance. RATIOmax contains the geometry term (Kg) and can be characterized in the machine or at the time of sensor manufacture.

The technique used to characterize the sensor in manufacturing is to measure the reflectance of a known spectral target and a known diffuse target with the patch sensor unit mounted at the nominal distance from the targets. A toner patch sensor (TPS) may use a standard spectral target with a reflectance similar to photoconductor to simulate photoconductor and a standard black diffuse target to simulate the reflectance from black toner. The ratio of the signal from the spectral reflectance target to the signal from the diffuse reflectance target is proportional to the RATIOmax for the sensor unit. This ratio must be multiplied in the machine algorithm by a "materials" constant which corrects for the differences of the target reflectances relative to the nominal photoconductor reflectance and the nominal toner reflectance in order to calculate an exact RATIOmax for that machine. Therefore, to obtain the RATIOmax figure, the "toner patch sensor (TPS) coefficient", which characterizes the particular sensor unit, must be placed as a label on the unit in manufacturing so that the coefficient can be entered into the machine when the sensor unit is installed. Entry of the TPS coefficient may be conveniently performed through the machine keyboard together with the materials constant. Alternatively, the materials constant and TPS coefficient can be combined outside the machine, placed as a "RATIOmax" label on the unit and entered directly through the keyboard. This latter approach is not preferred since the label is now specific to particular materials rather than just the sensor unit itself. As a consequence, the sensor unit is not labeled in a manner that makes it portable from machine family to machine family as it is when the TPS coefficient is on the label.

The technique used to characterize the sensor in the machine rather than in manufacturing is as follows. If a saturated toner patch can be developed in the machine such that no untoned photoconductor is visible, then RATIOmax can be calculated exactly from the ratio of untoned photoconductor reflectance and the saturated patch reflectance. The saturated toner patch may be generated in the machine using a patch development vector that is larger than normal (change charge level, illumination level and/or developer bias) and/or using higher than normal toner concentration. This could eliminate the manufacturing characterization procedure and since the measurement is done in the machine there is no measurement error due to mounting differences of the patch sensor. Any deviations in actual PC reflectance from nominal photoconductor reflectance are automatically compensated. Also, since reflectance is a function of LED wavelength in the patch sensor, wavelength is also compensated. Overall, determining RATIOmax in the machine yields more accurate results and therefore yields higher print quality at a lower cost as compared to characterization at the time of sensor manufacture. However, the latter may still be preferable if it is necessary to change toner concentration to a higher value than normal in order to achieve a saturated patch.

To restate, the problem of using the prior art simple ideal patch ratio algorithm to control toner mass developed in a high optical density machine is that the non-ideal characteristics of the particular patch sensor affect the toner patch measurements and thus the developed toner mass. The result of this is that the toner mass developed is not held at the proper level and print density or system reliability suffer. However, by simulating the ideal sensor in the non-ideal case proper coverage can be achieved. By solving the non-ideal ratio equation for the ideal ratio term and substituting the maximum ratio term, a ratio modification technique can be derived.

Let us start with the equation that expresses the non-ideal case (but still neglects the toner film factor)

$$\text{RATIO} = \frac{Rpc}{(1-a) * Rpc + a * Rt * Kg}$$

divide by $Rpc$ $$\text{RATIO} = \frac{1}{(1-a) * Rpc/Rpc + a * (Rt * Kg)/Rpc}$$

substitute the RATIOmax relationship derived above $$\text{RATIO} = \frac{1}{(1-a) + a * (1/\text{RATIOmax})}$$

solve for the RATIOideal term by substituting $$\text{RATIOideal} = \frac{1}{1-a}$$

$$\text{RATIOideal} = \text{RATIO} * \frac{\text{RATIOmax} - 1}{\text{RATIOmax} - \text{RATIO}}$$

note that RATIOmax is much greater than 1, therefore $$\text{RATIOideal} = \text{RATIO} * \frac{\text{RATIOmax}}{\text{RATIOmax} - \text{RATIO}}$$

or $$\text{RATIO} = \frac{\text{RATIOideal} * \text{RATIOmax}}{\text{RATIOideal} + \text{RATIOmax}}$$

This relationship demonstrates that quantified knowledge of the non-ideal characteristics of the sensing system combined with the theoretical ideal operating point yields a specific operating point that is suitable for the specific sensor system. This allows ideal performance to be realized with a non-ideal (low cost) sensor system.

Knowledge of the ideal ratio that results in the proper toner mass developed for a machine family and knowledge of the particular toner patch sensor's RATIOmax, provides a control ratio that will result in the proper amount of toner mass developed. This provides exact compensation for a sensor's non-ideal geometry characteristics and prevents the need for a sensor adjustment.

Note also that the ratio equation can be rearranged into the following:

$$\text{RATIO} = \frac{1}{1 - a * (1 - 1/\text{RATIOmax})}$$

This form of the equation is interesting because it is similar to the RATIOideal equation and illustrates another way that a control system could be implemented. The desired coverage area 'a' could be picked based upon nominal machine performance and RATIOmax could be characterized using the maximum RATIO of the specific machine sensor. As RATIOmax approaches infinity, the equation reduces to the equation for RATIOideal used in traditional patch sensing. Thus, the assumption made in traditional patch sensing is that RATIOmax is very large.

(B) Modification for Toner Film

Toner film often comes to reside on the photoconductor surface after a considerable degree of use. Such filming is a major factor in the non-ideal behavior of toner patch measurement since it causes a reduction in photoconductor reflectance. Various factors are combined into the term "toner film" as used here and include toner film, toner dust, and surface wear on the photoconductor surface. These factors can cause a significant shift in the operating point of the system and result in an improper amount of toner in the developer and thus the wrong toner mass developed.

Note that as toner film increases (reducing the toner film factor Ktf), the measured ratio becomes lower.

$$MR = \frac{Rpc\ Ktf}{(1-a)\ Rpc\ Ktf + Rt\ Kg}$$

This effect causes the developer toner concentration and the toner mass developed to increase as toner film increases when used in the prior art constant control ratio system.

By re-deriving the RATIO equation in terms of RATIOideal and RATIOmax but including the toner film factor (Ktf), we can see how the control ratio should be shifted to account for toner filming:

$$\text{RATIO} = \frac{\text{RATIOideal} * \text{RATIOmax} * Ktf}{\text{RATIOideal} + \text{RATIOmax} * Ktf}$$

This equation shows that if toner film information can be gained from patch sensor data or from a predicted toner film response curve, the control ratio can be modified on a real-time basis to account for the toner film and keep the toner mass developed at a constant level One approach to arriving at the proper control ratio when toner film is present is to use the previously mentioned technique for periodically characterizing RATIOmax in the machine. In this manner, RATIOmax will contain not only the sensor geometry characteristics but also the toner film information. Thus automatic compensation for both occurs as the control ratio is calculated.

Another approach to arriving at the Ktf value is to use the information from the analog toner patch sensor's reflectance reading of the photoconductor:

$$Ktf = \frac{\text{Reflectance (clean photoconductor)}}{\text{Reflectance (clean photoconductor new)}}$$

$$\text{Reflectance} = C * \frac{Vref}{Iref}$$

where:

Vref=sensor reference voltage from untoned photoconductor

Iref=sensor LED current when the measurement was made

C=proportionality constant

These relationships yield the toner film factor for the photoconductor in its present condition and can be used in the RATIO equation to calculate an accurate control ratio. If this is done periodically as the photoconductor ages, the control ratio is automatically shifted to keep the toner mass developed constant even while toner film is accumulating.

Figure 5:
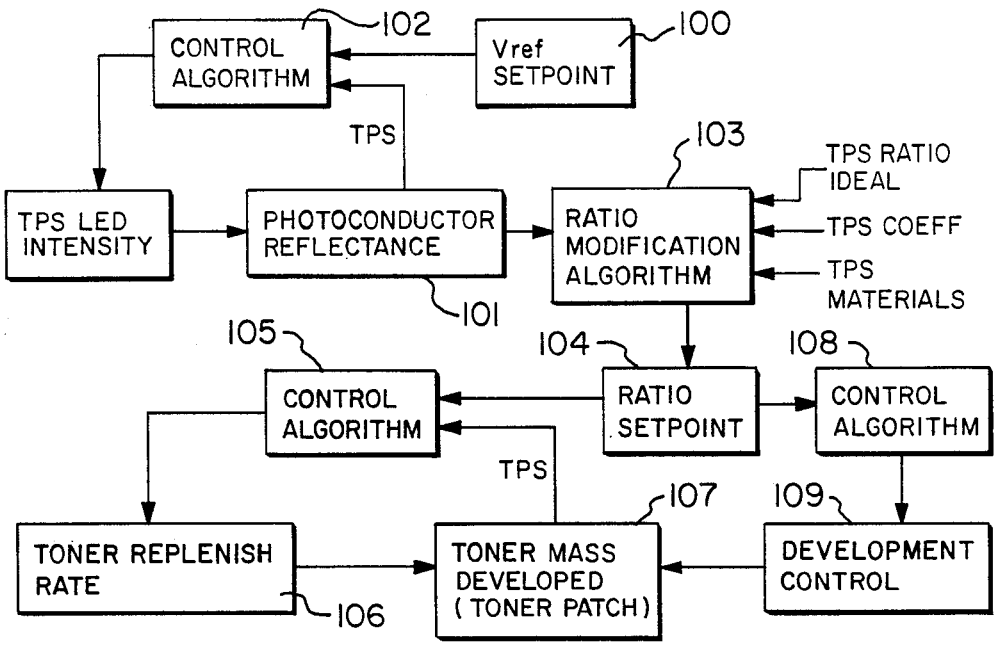
FIG. 5 is a flowchart of toner mass developed control with ratio modification in accordance with this invention for use in the machine of FIG. 1.

FIG. 5 is a flowchart of toner mass developed control with ratio modification included in accordance with this invention for practice on the machine shown in FIG. 1.

When toner mass developed is to be measured, a reflectance reading for bare photoconductor is taken as well as a reflectance reading for a toned patch. These measured quantities are fed as input into the Ratio Modification Algorithm, step 103, together with the RATIOideal figure which is held in memory within the machine. It should be noted that the RATIOideal figure is an empirically determined value for a family of machines and represents the control ratio giving the desired developed toner mass within that machine family. Thus, if a machine that is capable of color reproduction is using the instant invention a single RATIOideal value may be placed in memory for combination with a unique RATIOmax value for each toner color. Also, it is noted that should it be desirable to change the desired developed toner mass for a particular color, the RATIOideal figure could be empirically altered for the color.

As stated above, RATIOmax may be derived from measured quantities within the machine, or it may be a calculated quantity based upon sensor characterization at manufacture. If the sensor is characterized outside the machine, RATIOmax can be calculated and loaded into the machine. However, a more general approach that enables sensor units to be used in any machine family, is to load only a "TPS coefficient" into the machine and supplement with a "TPS materials" value to relate the TPS coefficient to the particular photoconductor and toner reflectivities in use in the machine. That is necessary since the TPS coefficient is derived outside the machine by testing the sensor with a standard specular target and with a standard diffused target. In any event, whether RATIOmax is derived from measured reflectances within the machine or calculated, the algorithm at step 103 performs calculations in accordance with the equation:

$$\text{Control Ratio} = \frac{\text{RATIOideal} * \text{RATIOmax}}{\text{RATIOideal} + \text{RATIOmax}}$$

This control ratio setpoint is established at step 104 and is input to the replenisher control algorithm at step 105 where the measured ratio is compared to the control ratio setpoint and the result may alter the toner replenishment rate at step 106. Thereafter, a toned patch is tested at step 107 to determine that the desired toner mass developed has been reestablished or that progress toward that end is being made.

Once the ratio setpoint is established at step 104, it may also be used as input to control algorithms at step 108 for adjusting the charge level, illumination level, and/or developer bias level at step 109, development control. Thereafter, a toned patch is tested at step 107 to determine that the desired toner mass developed has been reestablished or that progress toward that end is being made.

Figure 6:
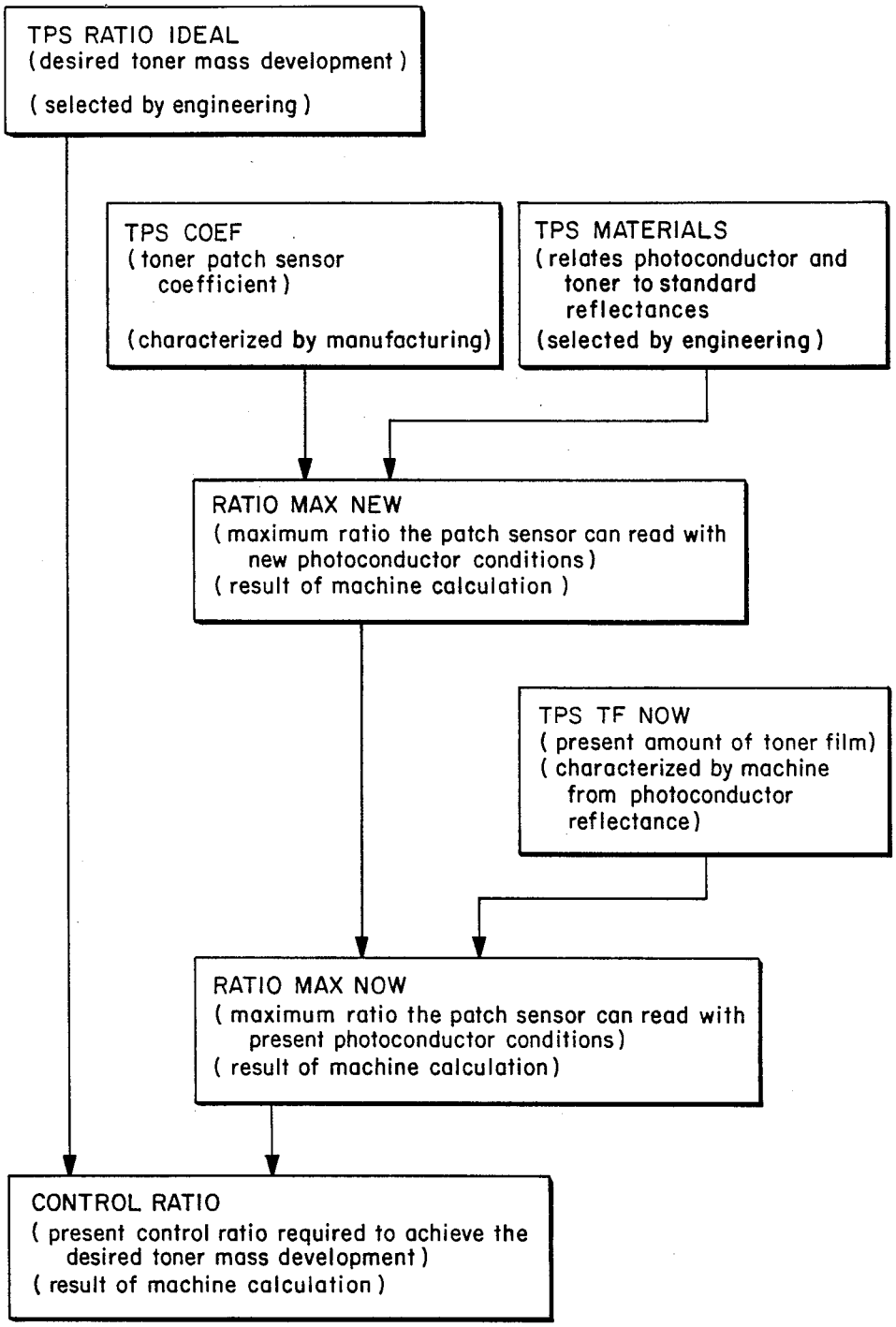
FIGS. 6 and 7 are flowcharts expanding the inventive step shown in FIG. 5.
Figure 7:
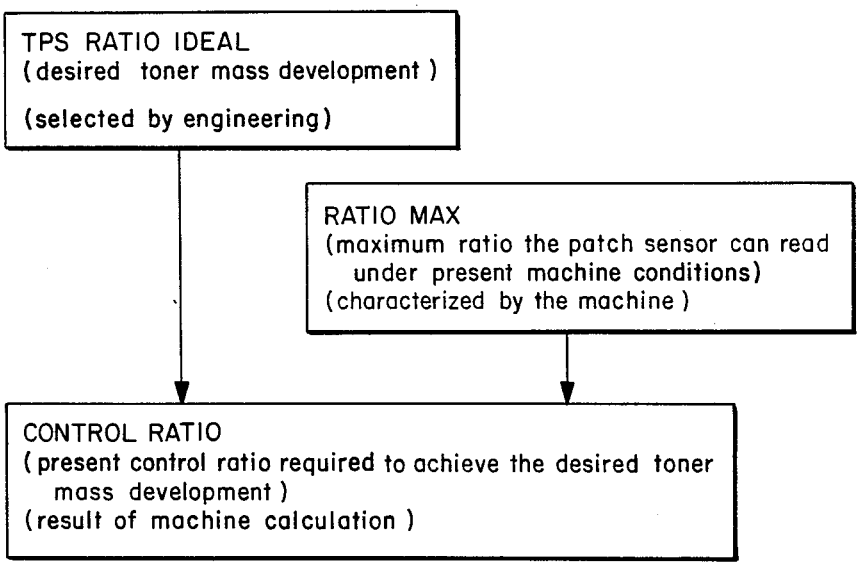

FIG. 6 is a flowchart showing step 103 of FIG. 5, in more detail using off-line sensor characterization. FIG. 7 shows step 103 in more detail using RATIOmax characterization within the machine itself.

FIG. 5 also shows a control loop for regulating the intensity of the patch sensor LED. The set point for the sensor is initially established at step 100 as a standard value. Bare photoconductor reflectance is measured at step 101 and the intensity modified at step 102 if the measured photoconductor reflectance is not the value expected. Intensity control is a standard prior art practice.

The invention described herein enables accurate control over toner concentration in all dual component reproduction/printing machines. The invention is also applicable to machines using monocomponent developer material with a patch sensing unit to control toner mass developed. In either case, control is obtained without utilizing maintenance personnel with expensive reflectometer equipment as sometimes has been previously needed. Low cost sensor units are used and accurate control maintained throughout photoconductor life even though photoconductor reflectance changes significantly in that life.

While the invention has been particularly shown and described with reference to a preferred embodiment thereof, it will be understood by those skilled in the art that the foregoing and other changes in form and details may be made therein without departing from the spirit and scope of the invention.

What is claimed is:

1. A method of controlling the toner mass developed in an image producing machine comprising the steps of:

producing a toned area and an area free of toner on image receiving material within said machine;

utilizing a reflectivity sensing unit to produce a first signal corresponding to the reflectivity of said toned area;

producing a second signal corresponding to the reflectivity of said area free of toner;

producing a third signal called the measured ratio which is the ratio of said first signal to said second signal;

calculating a control ratio setpoint wherein the control ratio calculation includes a variable which is dependent upon the particular sensing unit in use;

comparing said third signal to said control ratio set point; and adjusting toner mass developed in accordance with said comparison.

2. The method of claim 1 wherein said control ratio calculation is modified in accordance with a signal, RATIOmax, representing the maximum ratio that said sensing unit can produce from measuring the reflectivity of untoned image receiving material and from measuring the reflectivity of said toner.

3. The method of claim 2 wherein said RATIOmax signal is produced within said machine by producing a toned area saturated with toner and operating said sensing unit to test the reflectivity of said area saturated with toner together with measuring the reflectivity of untoned image receiving material.

4. The method of claim 3 wherein a new RATIOmax signal is produced whenever the sensing unit is changed.

5. The method of claim 2 wherein said RATIOmax signal is produced within said machine from data produced outside said machine and entered into said machine, said data including quantities obtained from testing said sensing unit using standard reflectivity objects and quantities representing the reflectivity of said toner and said image receiving material.

6. The method of claim 5 wherein said control ratio is also modified by a stored quantity representing the control ratio which would be in use under ideal conditions, RATIOideal.

7. The method of claim 6 wherein said control ratio is modified in accordance with the following algorithm:

$$\text{control ratio} = \frac{\text{RATIOideal} * \text{RATIOmax}}{\text{RATIOideal} + \text{RATIOmax}}$$

8. The method of claim 7 wherein said sensing unit is also used for producing said second signal.

9. The method of claim 3 wherein said control ratio is also modified by a stored quantity representing the control ratio which would be in use under ideal conditions, RATIOideal.

10. The method of claim 9 wherein said control ratio is modified in accordance with the following algorithm:

$$\text{control ratio} = \frac{\text{RATIOideal} * \text{RATIOmax}}{\text{RATIOideal} + \text{RATIOmax}}$$

11. The method of claim 10 wherein said sensing unit is also used for producing said second signal.

12. The method of claim 1 wherein said control ratio calculation is also dependent upon the current reflectivity of said area free of toner.

13. The method of claim 12 wherein said control ratio is modified by producing a signal, Ktf, representing the ratio of the reflectivity of unused image receiving material free of toner to the reflectivity of the current image receiving material in use when free of toner.

14. The method of claim 6 wherein said control ratio is modified by producing a signal, Ktf, representing the ratio of the reflectivity of unused image receiving material free of toner to the reflectivity of the current image receiving material in use when free of toner.

15. The method of claim 14 wherein said control ratio is modified in accordance with the following algorithm:

$$\text{control ratio} = \frac{\text{RATIOideal} * \text{RATIOmax} * Ktf}{\text{RATIOideal} + \text{RATIOmax} * Ktf}$$

16. The method of claim 9 wherein said control ratio is modified by producing a signal, Ktf, representing the ratio of the reflectivity of unused image receiving material free of toner to the reflectivity of the current image receiving material in use when free of toner.

17. The method of claim 16 wherein said control ratio is modified in accordance with the following algorithm:

$$\text{control ratio} = \frac{\text{RATIOideal} * \text{RATIOmax} * Ktf}{\text{RATIOideal} + \text{RATIOmax} * Ktf}$$

18. A method controlling toner mass developed in an image producing machine comprising the steps of:

producing a toned area and an area free of toner on image receiving material within said machine;

producing a first signal corresponding to the reflectivity of said toned area;

producing a second signal corresponding to the reflectivity of said area free of toner;

producing a third signal called the measured ratio which is the ratio of said first signal to said second signal;

calculating a control ratio setpoint wherein the control ratio calculation is dependent upon the current reflectivity of said area free of toner;

comparing said third signal to said control ratio setpoint; and adjusting toner mass developed in accordance with said comparison.

19. The method of claim 18 wherein said control ratio setpoint is modified by producing a signal, Ktf, representing the ratio of the reflectivity of unused image receiving material free of toner to the reflectivity of the current image receiving material in use when free of toner.

20. The method of claim 19 wherein said control ratio is also modified by a stored quantity representing the control ratio which would be in use under ideal conditions, RATIOideal.

21. The method of claim 20 wherein said control ratio is modified in accordance with the following algorithm: control ratio=RATIOideal * Ktf.

* * * * *